United States Patent [19]

Argo et al.

[11] 4,321,095

[45] Mar. 23, 1982

[54] SCRUBBING METHOD AND APPARATUS USING VIBRATING TERRY CLOTH

[76] Inventors: Dorothy P. Argo, P.O. Box 2747, Spartanburg, S.C. 29304; Anne A. Sanders, 244 Greengate La., Spartanburg, S.C. 29302

[21] Appl. No.: 202,602

[22] Filed: Oct. 31, 1980

[51] Int. Cl.[3] ..... B08B 1/00

[52] U.S. Cl. ..... 134/6; 15/98

[58] Field of Search ..... 134/6, 16; 15/4, 47, 15/50 R, 50 A, 97 R, 98, 230.17, 230.19

[56] References Cited

U.S. PATENT DOCUMENTS

| | | | |
|---|---|---|---|
| 1,689,166 | 10/1928 | Varner | 15/98 |
| 3,655,444 | 4/1972 | Young | 134/6 |
| 3,988,799 | 11/1976 | Strickland | 15/97 R |

FOREIGN PATENT DOCUMENTS

| | | | |
|---|---|---|---|
| 2028115 | 3/1980 | United Kingdom | 15/230.17 |

*Primary Examiner*—Richard V. Fisher

*Attorney, Agent, or Firm*—Bailey, Dority & Flint

[57] ABSTRACT

A method and machine for cleaning carpet, and the like floor surfaces, are disclosed which include a vibrating type machine having a vibrating drive plate which carries a layer of plastic barbed bristles facing the carpet. A piece of terry cloth is placed between the bristles and the carpet and the barbed bristles hook the loops of the terry cloth for attachment and massage the carpet through the terry cloth to impart a scrubbing motion to the cloth. Use of short looped terry cloth having terry loops of about one-fourth of an inch ($\frac{1}{4}''$) or less effectively results in transmission of machine motion for effective machine movement and cleaning. The method contemplates moistening a piece of terry cloth with a cleaning solution so that soil is removed and absorbed by the terry cloth without any significant wetting of the carpet after which the terry cloth may be removed from the barbed bristles and utilized on a reverse side or replaced. Removal of shampoo and soil is built into the method and machine in an effective manner.

9 Claims, 6 Drawing Figures

SCRUBBING METHOD AND APPARATUS USING VIBRATING TERRY CLOTH

BACKGROUND OF THE INVENTION

Heretofore, many different types of machines and methods for cleaning carpets have been proposed. Some of the more basic types are the rotary brushwet shampoo machine and method such as shown in U.S. Pat. No. 3,728,075 wherein a mop head is utilized as a pad and rotated over a wetted area of the carpet to shampoo the pile. The absorbent material of the mop head soaks up the soiled liquid detergent. However, this method often causes severe pile distortion and flaring of tufts and tends to clean only one side of the fibers in a pile due to the single rotary motion of the brush. Vacuuming is used to remove the shampoo and soil after shampooing but such methods are largely ineffective.

Other types of machines and methods utilize a cylindrical brush which scrubs the carpet pile. While such a machine does have a built-in vacuum to remove the shampoo and dirt following scrubbing, residue is often left in the carpet. The action of the rotating cylindrical brush often causes severe pile distortion and flaring of tufts and provides less cleaning than other techniques. Another type of machine and method is the vibrating plate machine which gives a cleaning action such as shown in U.S. Pat. No. 3,655,444 wherein a sheet of elastic material having a surface which is embossed or otherwise treated to be irregular is carried by a vibrating drive plate. The plastic scrub surface scrubs or agitates the carpet pile either during or after the pile has been wetted with a detergent solution. This method produces little pile distortion and flaring during cleaning, however, less cleaning is incurred than in the above methods and there is no means for removal of shampoo and soil except by subsequent vacuuming.

All of the above methods which utilize application of a shampoo or cleaning solution have the disadvantage that the carpet pile is directly and often over-wetted to the point of causing damage and requires an additional removal step of vacuuming or a prolonged drying period before use. The machinery utilized is quite heavy which limits the use and the type of person who can operate such a machine. Typically, such machines have been too heavy and unwieldy for housewives or female custodians to use.

SUMMARY OF THE INVENTION

Accordingly, an important object of the present invention is to provide machinery apparatus which is lightweight and can be used by housewives and any custodial employee for effective cleaning of carpeted and upholstered surfaces.

Another important object of the present invention is to provide a method and machine for cleaning carpet which is lightweight and simple to operate and which utilizes an inexpensive cleaning pad which may be readily attached and removed from the machine. It is desirable that the pad be reversible and re-usable to further reduce costs.

A further object of the invention is to provide a machine and method for cleaning carpet which is gentle and does not distort and disturb the carpet pile or cause excessive pile distortion and flaring and thus preserves the normal life of the carpet.

Still another important object of the present invention is a machine and method for effectively cleaning carpet with a cleaning solution which does not directly wet the carpet with a liquid either fed or contained at the machine, and in which soil and shampoo removal is built into the method and machine.

The above objectives are accomplished according to the present invention by a towel machine which utilizes a ply of terry cloth moistened with a cleaning solution and given a mechanical scrubbing motion by a lightweight vibrating machine whereby soil is absorbed onto the toweling. The vibrating machine includes a vibrating drive plate having a plurality of barbed plastic bristles or fingers on a bottom thereof which are placed directly on the terry cloth. The terry cloth is attached to the machine and motion effected by means of the barbed bristles which hook and engage the loop pile and fabric of the terry cloth during vibration. The barbed bristles act like a multitude of fingers engaging the terry cloth and holding it against the carpet and owing to the lightness of the machine, causes the toweling to move over the floor quite easily in a scrubbing action. The terry cloth has pile on both sides and is easily attached and removed for cleaning on the reverse side and for replacement.

The vibrating machine is simplified and very light weight, weighing approximately fifteen pounds; and owing to the lightness, use of short-loop terry cloth, and motion imparted to the terry cloth, the soil tends to be lifted from the carpet pile and absorbed into the solution on the terry cloth as opposed to the heavier machines which often tend to force the dirt deeper into the pile. The vibrating action of the drive plate imparts a motion to the toweling which wipes the carpet pile on all sides giving uniform and even cleaning to the carpet pile. The terry cloth pad may be easily removed and replaced when soiled, and washed in a conventional washing machine for re-use. The machine and method are extremely well suited for use by the housewife or female custodian and owing to the simplicity of the method may be used for cleaning small spots or for a whole carpet conveniently. The machine and method result in quick and simplified cleaning of small or large carpeted areas due to the effective shampoo and soil removal built into the machine and method. The machine is light enough to be used on upholstered surfaces.

BRIEF DESCRIPTION OF THE DRAWINGS

The construction designed to carry out the invention will be hereinafter described, together with other features.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
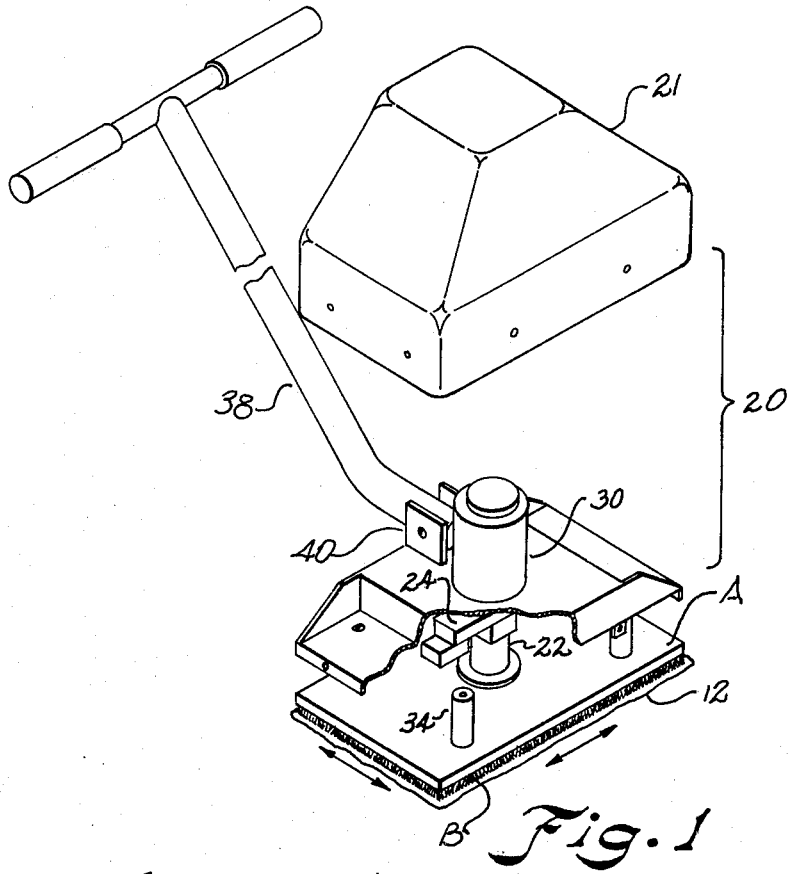
FIG. 1 is a perspective partially cut-away view illustrating a towel machine and method for cleaning carpets according to the present invention.
Figure 2:
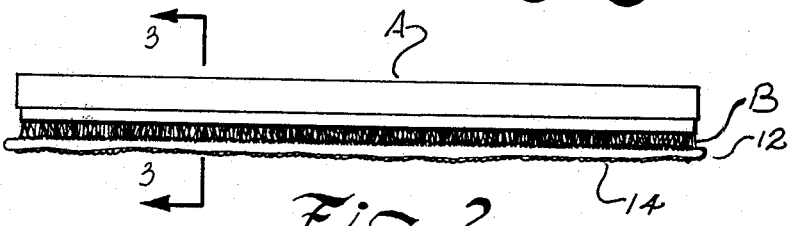
FIG. 2 is a front elevation illustrating a vibrating plate having a surface facing the carpet which includes a plurality of barbed plastic fingers for engaging terry cloth for cleaning according to the invention.
Figure 3A:
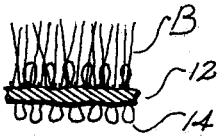
FIG. 3*a* is an enlarged view illustrating the barbed finger and terry loop construction of FIG. 3.
Figure 3:
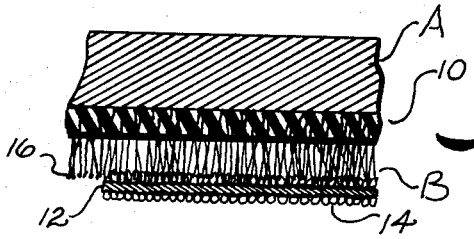
FIG. 3 is a sectional view taken along line 3—3 of FIG. 2.
Figure 4:
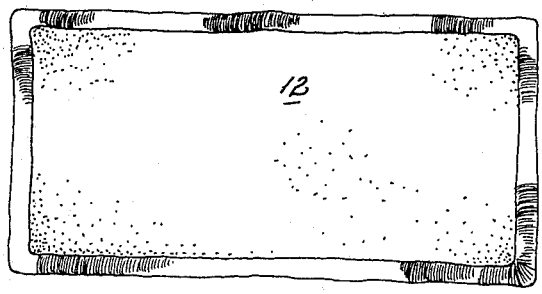
FIG. 4 is a top plan view of a terry cloth toweling utilized in a machine and method for cleaning carpets according to the invention.
Figure 5:
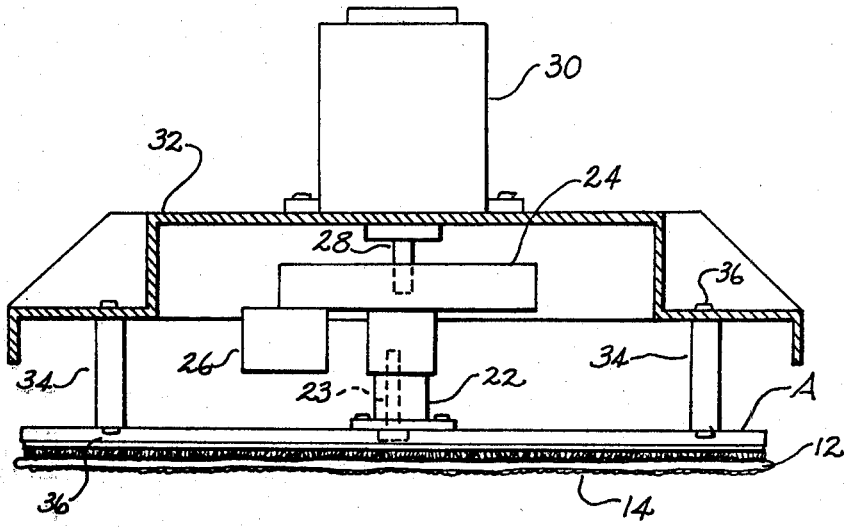
FIG. 5 is a front elevation, partially sectional view illustrating the machine of FIG. 1.

The invention relates to the cleaning of carpet and upholstered surfaces and the like and in particular to a method of cleaning carpet is disclosed which includes imparting mechanical scrubbing motion to terry cloth toweling which is moistened with a cleaning solution. A vibrating machine is provided having a drive plate movable in short rapid oscillations which produces a vibrating motion and effect. A plurality of plastic barbed bristles are fixed to the bottom of the drive plate and are adapted for engaging the terry cloth. The terry cloth is placed upon the surface to be cleaned and attached with the drive plate by means of the barbed bristles hooking the loops of the terry cloth. A scrubbing motion is imparted by the vibrating bristles acting as a multitude of fingers while engaging the loops and fabric of the terry cloth tending to wipe the pile of the carpet from all sides. As the vibrating scrubbing motion is imparted to the terry cloth the machine and cloth are easily moved over the carpet pile.

The method contemplates utilizing a single ply or layer of conventional woven terry cloth which has a short loop pile on each side thereof such as a common bath towel. The terry cloth is attached solely by means of the barbs and hooks of the bristles engaging the loop pile of the terry cloth which affords quick removal and attachment of the terry cloth. The barbed fingers engage the loops and fabric of the terry cloth as a multitude of fingers positively holding the cloth during vibration and scrubbing. The method may be most conveniently carried out by first placing the terry cloth material on the carpet and then setting the machine on the terry cloth material whereby the two are attached. Due to the lightness of the machine and vibratory scrubbing motion imparted to the terry cloth, soil tends to be lifted from the carpet pile and absorbed by the terry cloth. After one side of the terry cloth is heavily soiled, the terry cloth may be removed and the reverse side of the terry cloth placed on the carpet whereupon the machine may again be sat on the cloth and the cleaning steps repeated.

The above method may be most conveniently carried out by the following apparatus which includes a vibrating machine having a vibrating drive plate A which is driven in short rapid oscillations to produce a vibrating motion. A plurality of barbed plastic bristles B are carried on the bottom of the vibrating drive plate and are imbedded in a molded rubber-like plastic composition 10 affixed to the bottom of the drive plate A by a suitable adhesive. The cleaning pad consists of a single ply of terry cloth 12 having loop pile 14 on both sides thereof.

The bristles are formed from any suitable plastic such as nylon and the ends include barbs or hooks 16 which resemble the ball formed on the end of a plastic strand such as by singing or cutting obliquely. Barbed fingers B are affixed to drive plate A by means of cementing the bonded layer 10 to the bottom thereof. The barbed fingers are randomly mixed in direction and exert and resist forces in all directions of oscillation to effectively impart motion to the terry cloth. Bristles B thus affixed are semi-rigid but sufficiently elastic to impart motion without breakage. Suitable bristle pad material is available from the 3-M Company of St. Paul, Minn.

It has been found extremely important to the invention that terry cloth having short loops be utilized so that the vibrating motion of the drive plate is imparted directly to the terry cloth and carpet pile and not absorbed by the loops themselves. Long loops allow for too much play and absorb the vibration of the plate whereby the machine will not vibrate the pad or move over the carpet. For this purpose, it has been found that toweling having terry loops of about one-eighth of an inch is required, although in some instances loops up to one-fourth inch may apply. It has been found that a thick but lightweight pad, such as a bath mat or towel weight, having terry loops of one-eighth of an inch works extremely well. The weight of material must allow the vibratory massaging action of the fingers to reach the carpet or surface being cleaned for effective cleaning. Thicker toweling such as the use of double layer pads tend to not allow effective transmission of vibrating finger action onto the carpet for scrubbing and movement. Toweling constructed of cotton yarns has been found to have highly suitable absorbancy characteristics for use in the method and apparatus according to the invention.

Referring now to FIG. 1, it can be seen that the vibrating machine designated generally as 20 includes a housing 21 which encloses the internal parts of the machine. The vibrating plate A includes a bearing block and retainer 22 with two roller bearings (not shown) mounted centrally of the drive plate A. The drive plate A is mounted off center to a counterbalanced member 24 having a counterweight 26 at one end thereof. The counterbalanced member 24 is attached centrally to a drive shaft 28 of an electric motor 30 which is bolted on to a housing 32. At generally the four corners of the drive plate A rubber mounts 34 are provided which extend between the drive plate and the housing 32 and are attached therebetween by means of suitable screws 36. The rubber mounts allow drive plate A to swing in vibrating oscillations. A handle 38 is attached between a pair of upstanding legs 40 of a mounting bracket carried by the housing 32 and secured by means of a nut and bolt. A conventional on-off switch may be provided for energizing the electric motor 30. In a preferred embodiment of the machine, the motor 30 is a 115 volt electric motor having a speed of approximately 2700 rpm's.

Drive plate A is mounted by means of bolt 23 approximately 0.15" off the center of the drive shaft axel 28. Short rapid oscillations are imparted to the drive plate A which produce a vibrating motion and effect appearing at the plate which appears as a scrubbing motion at the carpet. It has been found that a pad of terry cloth toweling as described herein, when attached and vibrated by such a machine, imparts a highly effective scrubbing action to the pile of the carpet in such a manner that all sides of the pile of carpet, whether cut or uncut, are cleaned evenly and effectively.

While a preferred embodiment of the invention has been described using specific terms, such description is for illustrative purposes only, and it is to be understood that changes and variations may be made without departing from the spirit or scope of the following claims.

What is claimed is:

1. A method of cleaning carpet and the like surface, comprising:

(a) supplying a piece of terry cloth including terry loops and fabric;
(b) moistening said terry cloth with a cleaning solution;
(c) providing a vibrating machine having a vibrating drive plate movable in short rapid oscillations producing a vibrating motion and effect;
(d) providing a plurality of semi-rigid generally elastic barbed fingers affixed to a bottom of said drive plate adapted for engaging said terry cloth;
(e) placing said terry cloth upon said carpet to be cleaned;
(f) engaging said barbed fingers and said terry cloth;
(g) imparting a scrubbing motion to said terry cloth by means of said barbed fingers engaging said loops and fabric of said terry cloth and massaging said carpet pile through said terry cloth as a multitude of fingers, said motion wiping carpet pile generally on all sides thereof;
(h) moving said machine over said carpet whereby said carpet is scrubbed and cleaned by means of the motion imparted to the terry cloth by said vibrating drive plate; and
(i) utilizing short-loop terry cloth having loops of sufficiently short lengths that said vibrating motion is not absorbed by said loops but is directly imparted to said cloth and carpet pile for effective machine movement and cleaning.

2. The method of claim 1 wherein said terry cloth is attached to said drive plate by means of hooks and barbs of said barbed fingers engaging loops of said terry cloth.

3. The method of claim 2 wherein said terry cloth is attached with said drive plate by first placing said terry cloth on said carpet and then setting said machine and drive plate on said cloth.

4. The method of claim 2 including removing said terry cloth from said drive plate by pulling said cloth from said barbed fingers and repeating the steps of (e) through (h) utilizing the reverse side of said terry cloth.

5. The method of claim 1 wherein said terry cloth is supplied by a single ply of terry cloth having terry loops on both sides providing reversible attachment and cleaning surfaces.

6. The method of claim 5 wherein said terry cloth consists of cotton yarns.

7. Apparatus for cleaning carpet and the like surface, of the type which includes a drive plate and, means for driving said drive plate in short rapid oscillations to produce a vibrating motion and effect, wherein the improvement comprises:

a plurality of semi-rigid generally elastic barbed fingers affixed to a bottom of said drive plate;

a cleaning pad consisting of a piece of terry cloth having terry loops on both sides thereof;

said cleaning pad being attached to said drive plate solely by hooks and barbs of said barbed fingers engaging said loops of said terry cloth;

said drive plate imparting said vibrating motion to said terry cloth cleaning pad when so attached for scrubbing and cleaning said carpet; and said loops of said terry cloth being less than about one- fourth inch in length.

8. The apparatus of claim 7 wherein said barbed fingers extend randomly in direction from the bottom of said drive plate to exert and resist forces in the direction of said oscillation to effectively move said terry cloth pad in a scrubbing motion which generally wipes all sides of the carpet pile.

9. The apparatus of claim 8 wherein said hooks and barbs of said barbed fingers generally hook the loops and engage the fabric of the terry cloth for effectively imparting said scrubbing motion to said pad facilitating movement of the machine and pad over said carpet for cleaning thereof.

* * * * *